United States Patent [19]

Drewitz

[11] 4,152,687

[45] May 1, 1979

[54] CONDUCTIVE PLASTIC MULTI-TURN POTENTIOMETER

[75] Inventor: Edwin Drewitz, Manhasset, N.Y.

[73] Assignee: Litton Systems, Inc., Mount Vernon, N.Y.

[21] Appl. No.: 846,172

[22] Filed: Oct. 27, 1977

[51] Int. Cl.[2] ..... H01C 10/24

[52] U.S. Cl. ..... 338/143; 338/171; 338/185; 338/202; 338/311

[58] Field of Search ..... 338/143, 148, 180, 185, 338/195, 171, 202, 252, 303, 305, 311; 29/610

[56] References Cited

U.S. PATENT DOCUMENTS

| | | | |
|---|---|---|---|
| 1,767,715 | 6/1930 | Stoekle | 338/195 X |
| 1,767,715 | 6/1930 | Stoekle | 338/300 |
| 2,662,146 | 12/1953 | Wilentchik | 338/143 |
| 2,662,149 | 12/1953 | Wilentchik | 338/120 |
| 2,775,673 | 12/1956 | Johnson | 338/195 X |
| 2,917,814 | 12/1959 | Ruckelshaus | 338/143 X |
| 2,938,396 | 5/1960 | Nicolosi et al. | 338/143 X |
| 2,962,393 | 11/1960 | Ruckelshaus | 338/308 |
| 3,175,278 | 3/1965 | Fuller | 29/620 |
| 3,564,476 | 2/1971 | Barden | 338/120 |
| 3,648,216 | 3/1972 | Rector | 338/195 X |
| 3,659,339 | 5/1972 | Yamaguchi | 29/620 |

FOREIGN PATENT DOCUMENTS

| | | | |
|---|---|---|---|
| 1537840 | 7/1968 | France | 338/143 |
| 1002048 | 8/1965 | United Kingdom | 338/308 |

*Primary Examiner*—C. L. Albritton

*Attorney, Agent, or Firm*—Brian L. Ribando

[57] ABSTRACT

A resistance element comprises an insulating cylinder having a helical thread groove on the outer surface thereof. A resistive channel is supported by the groove and a multi-strand wiper is guided by a follower which rides in the root of the channel. The resistance material on the sides of the groove may be notched for purposes of calibration.

5 Claims, 2 Drawing Figures

Fig_1
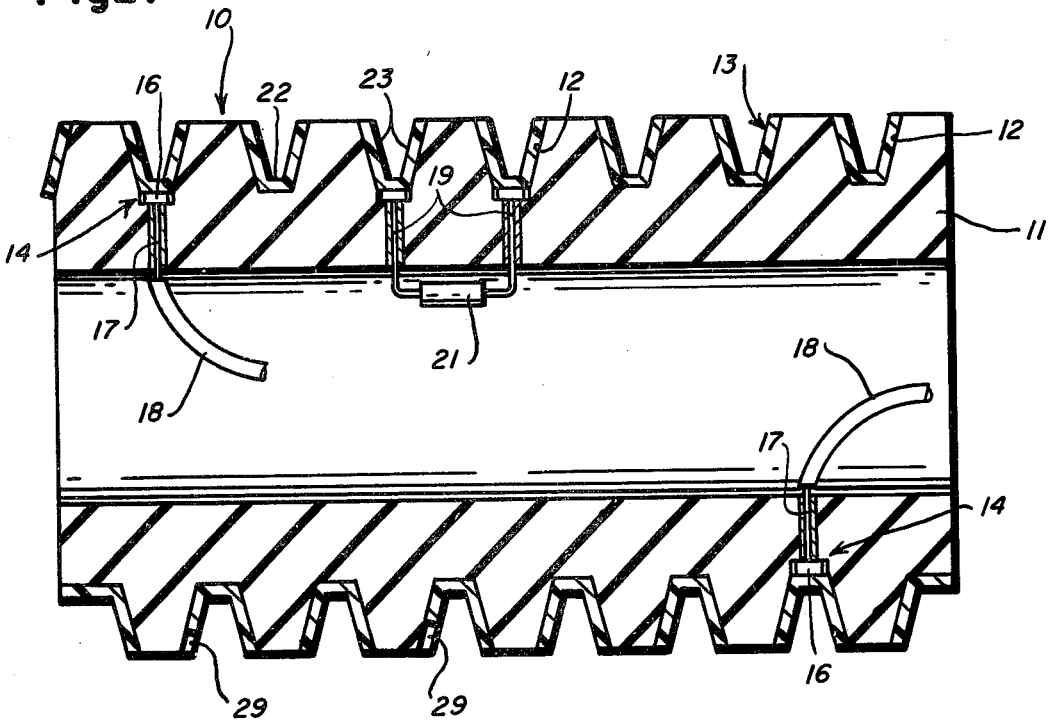
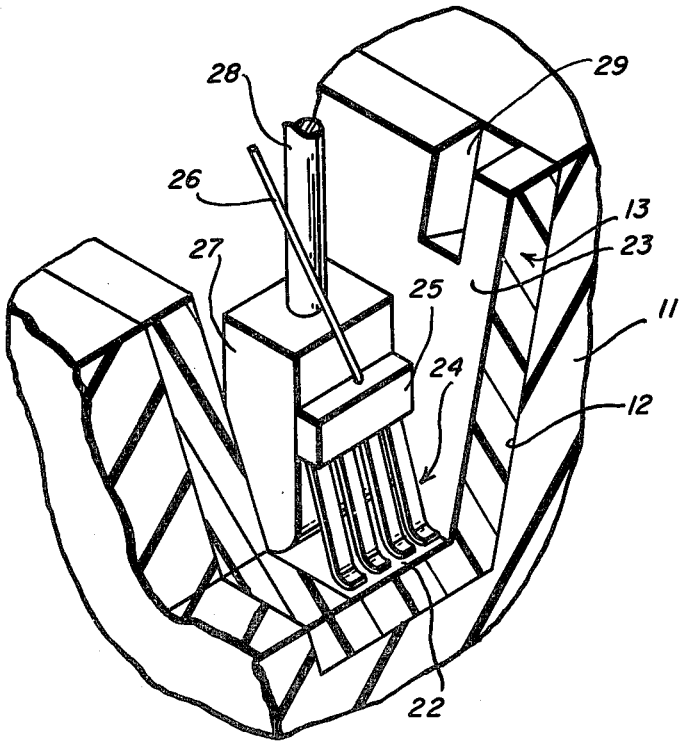
Fig_2

CONDUCTIVE PLASTIC MULTI-TURN POTENTIOMETER

BACKGROUND OF THE INVENTION

The invention relates to a cylindrical resistance element, and more particularly to a resistive plastic channel supported in a helical groove formed on the surface of an insulating cylinder in which a wiping contact is guided in the root of the channel.

Known prior art multi-turn conductive plastic potentiometers may be characterized as being one of two types. A precision grade of potentiometer comprises a cylindrical resistance element in which a helical screw thread has been cut through an externally disposed resistive coating to form a helical strip of resistance material. The helical strip functions as a resistance element, and the helical screw thread functions to guide a wiping contact which is disposed within the thread. A semi-precision grade of potentiometer comprises a rectilinear or flat strip resistance element and a wiper assembly which is guided by a lead screw. Using this construction, resistance ranges and conformity accuracies are limited because of the relatively short lengths which the resistance elements may not exceed in order to meet specification frame sizes.

SUMMARY AND OBJECTS OF THE INVENTION

The invention comprises a resistance element which is formed on an insulating cylinder, the cylinder having a helical thread groove formed on the outside curved surface thereof. A channel of resistive material is supported within the helical thread groove. Terminations for the resistance element are formed by eyelets which are mounted in the wall of the insulating cylinder so as to be in contact with the resistive plastic material. A multi-strand wiper is attached to an insulating follower, and the follower is supported so as to be guided in its movement within the helical channel of resistive material. The resistive material comprising the sides of the channel may be trimmed by notching in order to achieve the desired linearity along the length thereof.

It is therefore an object of the invention to provide a multi-turn resistance element.

It is another object of the invention to provide a conductive plastic multi-turn resistance element wherein a channel of resistive material is disposed in a helical groove formed on the outer surface of a cylinder.

It is another object of the invention to provide a conductive plastic multi-turn resistance element wherein a channel of resistive material which may be notched for calibration purposes is disposed in a helical groove on the outer surface of an insulating cylinder and wherein a multi-strand wiper is supported so as to electrically contact the resistance material in the channel and to be guided thereby.

These and other objects of the invention will become apparent from the following detailed description taken in conjunction with the accompanying drawing figures in which like reference numerals designate like or corresponding parts throughout the figures.

BRIEF DESCRIPTION OF THE DRAWING

FIG. 1 is a sectional view of a cylindrical resistance element; and

FIG. 2 is a view, partly in section, of a wiper element disposed in a channel of resistive material.

DESCRIPTION OF THE PREFERRED EMBODIMENT

Referring now to the drawings, there is shown in FIG. 1 a cylindrical resistance element generally designated by reference numeral 10. The element comprises a cylinder 11 of insulating material. The cylinder is formed with a helical groove 12 on the outside surface thereof. A continuous channel 13 of resistive material is supported within the groove 12. Terminations 14 are formed at either end of the cylinder 11, and each termination comprises an eyelet 16 which is of conductive material. A conductor 17 of a termination lead 18 is fastened to the eyelet 16 as by soldering. Each eyelet 16 is mounted in the insulating cylinder 11 so that the head of the eyelet is in contact with the channel 13 of resistive material. A plurality of compensating taps 19 may also be provided at spaced points along the insulating cylinder 11. The compensating taps may be used to couple circuit elements such as a resistor 21 to the channel 13 of resistive material in order to shape resistance conformity curves. The taps are mounted in the cylinder 11 so as to be in contact with the channel 13, and receive the leads of the resistor 21 which are connected thereto by suitable means such as soldering.

Turning now to FIG. 2, it will be seen that the channel 13 of resistive material comprises a root portion 22 and sidewall portions 23. A multi-strand wiper 24 is in contact with the root 22 of the helical channel 13, and the strands are ganged together by a wiper block 25. A wiper lead 26 is electrically connected to the wiper block 25, and the wiper block 25 is fixed to the body of an insulating follower 27. The follower is positioned within the channel 13 by a follower support 28. It will be appreciated by those skilled in the art that the follower support may be attached to a mechanism which is suitable to allow the support to traverse the length of the cylindrical resistance element as the insulating follower is guided in a path which is determined by the root of the helical channel 13. In order to calibrate the channel 13 when it is desired that the resistance of the channel taken along its length exhibit a high degree of linearity of accuracy in conforming with a given resistance curve, the use of one or more notches 29 may be employed. The notches 29 may be positioned on the sidewall portion 23 and effectively limit the amount of resistive material which comprises the channel 13. It will be noted that the notches 29, since they are located entirely on the sidewall 23, do not interfere with the contact of the wiper strands 24 on the root portion 22.

It is contemplated that the insulating cylinder 11 be made of any non-conductive material such as a plastic. The grooves on the surface of the cylinder may be formed by a machining or molding process. The continuous channel of resistive material may be plastic, ceramic, or metallic in nature and may be formed within the grooves by plating, spraying or by other processes known to those skilled in the art. While a resistive channel having straight sides and a straight root portion has been disclosed, a channel having curved sides and a rounded bottom portion may also be employed. Of course, where such a construction is utilized, the insulating follower and the wiper strands should be configured so as to closely conform to the shape of the channel. The resistance element may be linear rather than cylindrical, in which instance, it is possible to have a single flat resistance element or a plurality of side by side elements formed on a single insulating base.

The operation and use of the device will be obvious to those skilled in the art. Relative rotary motion between the insulating follower and the cylindrical element will cause the follower to track the helical resistance channel while being positioned in the track by the follower support. The wiper strands are in physical contact with the root portion of the channel and create an electrical connection between the wiper lead and the termination leads. The resistance developed by the element is proportional to the distance between the termination leads and the wiper strands, measured along the helical channel. Adjustment of the developed resistance may be made by rotating the insulating cylinder relative to the follower, causing the follower to be advanced to a new position along the helical channel.

I claim:

1. A multi-turn potentiometer comprising:
a core of insulating material having a cylindrical surface,
a helical groove formed on the cylindrical surface,
a channel of plastic resistive material supported within the helical groove, said channel having a flat root portion and flat sidewall portions,
a follower in contact with the channel sidewalls,
means attached to the follower for maintaining the follower in the channel as the channel is moved relative thereto,
a wiper fixed to the follower and in riding contact with the root portion of the channel,
at least one notch formed in the sidewall portion of the channel,
spaced terminations mounted in said core and contacting said resistive material,
a plurality of termination leads connected to said terminations, and
a wiper lead coupled to said wiper.

2. A multi-turn potentiometer comprising:
a base of insulating material having a cylindrical surface,
a helical groove having a root portion and a sidewall portion on the cylindrical surface,
a resistive channel having a root portion and a sidewall portion supported in the helical groove,
a wiper in contact with the resistive channel,
a support means attached to the wiper for positioning the wiper within the resistive channel,
a follower attached to the support means, said wiper being mounted on the follower, a portion of the follower being in contact with the root portion of the resistive channel, and
a plurality of conductive strands comprising the wiper.

3. The potentiometer of claim 2 further comprising:
terminations positioned at spaced points along the helical groove and in contact with the resistive material, and
termination leads connected to the terminations.

4. The potentiometer of claim 2 further comprising:
means for adjusting the resistance of the resistive channel taken along the length thereof, said means comprising at least one notch formed in the resistive channel.

5. The potentiometer of claim 2 further comprising:
means for compensating the resistance of the resistive channel between two points spaced from one another along the channel, said means comprising a plurality of taps connected to the resistive channel and a resistance element connected to the taps.

* * * * *